US006260603B1

(12) United States Patent
Vuignier et al.

(10) Patent No.: US 6,260,603 B1
(45) Date of Patent: Jul. 17, 2001

(54) METHOD FOR VERTICAL CONTINUOUS CASTING OF METALS

(75) Inventors: Eric Vuignier, Champlan; Etienne Caloz, Miège; Jean-Pierre Seppey, Champlan, all of (CH)

(73) Assignee: Alusuisse Technology & Management Ltd., Neuhausen (CH)

( * ) Notice: Subject to any disclaimer, the term of this patent is extended or adjusted under 35 U.S.C. 154(b) by 0 days.

(21) Appl. No.: 09/355,241

(22) PCT Filed: Jan. 7, 1998

(86) PCT No.: PCT/CH98/00004

§ 371 Date: Jul. 26, 1999

§ 102(e) Date: Jul. 26, 1999

(87) PCT Pub. No.: WO98/32559

PCT Pub. Date: Jul. 30, 1998

(30) Foreign Application Priority Data

Jan. 24, 1997 (EP) ..... 97810035

(51) Int. Cl.[7] ..... B22D 11/18; B22D 11/20

(52) U.S. Cl. ..... 164/453; 164/454; 164/483

(58) Field of Search ..... 164/453, 483, 164/449.1, 450.1, 155.4, 155.5, 454

(56) References Cited

U.S. PATENT DOCUMENTS 4,567,935 2/1986 Takeda et al. ..... 164/450.1
4,730,660 3/1988 Tinnes et al. ..... 164/453
5,174,361 * 12/1992 Karsfeld ..... 164/453
5,409,054 * 4/1995 Moriceau ..... 164/453

* cited by examiner

*Primary Examiner*—Nam Nguyen
*Assistant Examiner*—I.-H. Lin
(74) *Attorney, Agent, or Firm*—Cohen, Pontani, Lieberman & Pavane

(57) ABSTRACT

A method for automatic, vertical continuous casting of metals, in particular aluminium alloys, in a casting facility having several molds. According to the method, the liquid metal is fed from a furnace along a spout to the molds and guided, via nozzles with adjustable through-flow, to the molds which are initially closed off by the dummy blocks arranged on a lowerable casting table. The metal through-flow volume of each nozzle is adjusted individually for each mold on the basis of an initial time ($t_0$) and an initial metal level ($N_0$) at which adjustment of the metal level begins, in such a way that the metal in all molds at a pre-set starting time ($t_S$) is at substantially the same starting level ($N_S$) at which the casting table starts being lowered for the production of the metal strands. The metal level (N) is adjusted simultaneously during filling between the initial level ($N_0$) at the initial time ($t_0$) and the starting level ($N_S$) at the starting time ($t_S$) in all molds on the basis of time (t) in accordance with a set-point curve N=f(t) which is identical for all molds. The slope dN/dt of the set-point curve is greater in a range starting from the initial level ($N_0$) and smaller in a range in relation to the starting level (Ns) than the mean slope $(N_S-N_0)/(t_S-t_0)$ between the initial and the starting level.

9 Claims, 2 Drawing Sheets

METHOD FOR VERTICAL CONTINUOUS CASTING OF METALS

CROSS-REFERENCE TO RELATED APPLICATION

This application is a 371 of PCT/CH98/00004, filed on Jan. 7, 1998.

BACKGROUND OF THE INVENTION

1. Field of the Invention

The invention relates to a method for automatic, vertical continuous casting of metals, in particular aluminium alloys, in a casting facility comprising several molds in which the liquid metal is fed from a furnace along a spout to the mold and guided, via nozzles with adjustable through-flow, to the mold which are initially closed off by dummy blocks arranged on a lowerable casting table. The metal through-flow volume of each nozzle is adjusted individually for each mold on the basis on an initial time and an initial metal level at which adjustment of the metal level begins, in such a way that the metal in all molds at a pre-set starting time is at substantially the same starting level at which the casting table starts to be lowered for the production of the metal strands.

2. Discussion of the Prior Art

Trouble-free operation of a multi-strand casting facility depends greatly on mastering the start-up phase of casting i.e. on achieving optimum control of the process of feeding metal to the individual casting units up to the actual start of casting which begins with the lowering of the casting table.

During the dummy-block/mold filling-phase it is normal to adjust the metal flow individually to each mold via the specific mold nozzles, the through-flow volume of which can be variably set by motor-driven plugging rods. At the same time, using known methods and means of measuring, the level of metal in each mold is continuously measured, compared with target values and the rate of metal flow into the mold adjusted via the difference between the target and actual values by corresponding control of the plugging-rod drive.

A means for adjusting the metal level in a multi-strand casting facility is known from GB-A-2 099 189 whereby, on reaching a first level of metal in one mold, a set-point value that increases linearly as a function of time is specified for a common second level for all molds. Adjustment of the metal level in the individual molds is made on the basis of the rising set-point value, as soon as this is reached in the individual molds.

The European EP-B-0 517 629 describes a method of the kind initially described above in which the individual adjustment of the metal level in each mold is made as soon as the inflowing metal has reached a prescribed minimum height above the dummy block. Starting from this minimum height above the dummy block, the adjustment of the metal level in each mold is made via individual, set-point curves comprising data points that increase linearly as a function of time, with the result that a predetermined, common level is reached simultaneously in all of the molds.

A significant disadvantage of the state-of-the-art method using different filling curves for each mold is the danger that the system can get out of control if one of the molds does not begin to fill or does so with delay as a result of premature solidification. Further, large differences in the kinetics of mold filling can occur on lowering the casting table if individual molds fill too late and consequently exhibit a steep filling curve towards the end of the filling process. Also, with different filling curves the algorithms become much more complex.

SUMMARY OF THE INVENTION

The object of the invention is therefore to provide a method by means of which the level of metal in the individual molds can be adjusted during the dummy-block/mold filling-phase in a simple manner and, in as short a time as possible, brought to a predetermined level for the start of the lowering of the casting table, this without danger of the metal freezing.

The object is achieved by way of the invention in that the metal level is adjusted in all molds simultaneously during filling, between the initial level at the initial time and the starting level at the starting time, and as a function of time in accordance with a set-point curve $N=f(t)$ which is identical for all molds, whereby the slope $dN/dt$ of the set-point curve is greater in a range starting from the initial level and smaller in a range approaching the starting level than the mean slope between the initial and the starting level.

By way of preference, the part of the slope of the set-point curve with the greater slope, starting from the initial level, extends over a range comprising approximately 10 to 70%, preferably 30 to 60%, of the whole increase in metal level. The part of the set-point curve with the smaller slope approaching the starting level extends preferably over a range comprising 10 to 40%, preferably 15 to 25%, of the whole increase in metal level.

In practice it has been found that control of sufficient accuracy can be achieved if the set-point curve is made up of 4 to 8, preferably 5 to 6, pairs of values.

A simple and practical manner of carrying out the method according to the invention is such that the adjusting of the metal level in all the molds begins simultaneously as soon as the initial level has been reached in one mold. Usefully, the lowering of the casting table with the dummy blocks also begins as soon as the starting level has been reached in one mold.

Also the level of metal in the spout is preferably kept constant from the start of filling the dummy blocks and molds, up to and including the stationary casting phase.

The feeding of metal to the moulds is preferably proportional-integral-derivative (PID) controlled on the basis of the set-point curve.

BRIEF DESCRIPTION OF THE DRAWINGS

Further advantages, features and details of the invention are revealed in the following description of a preferred exemplified embodiment of the invention and with the aid of the drawing which shows schematically in FIG. 1 a simplified cross-section through a part of a mold with a dummy block already being lowered.

DETAILED DESCRIPTION OF THE PREFERRED EMBODIMENTS

Figure 2:
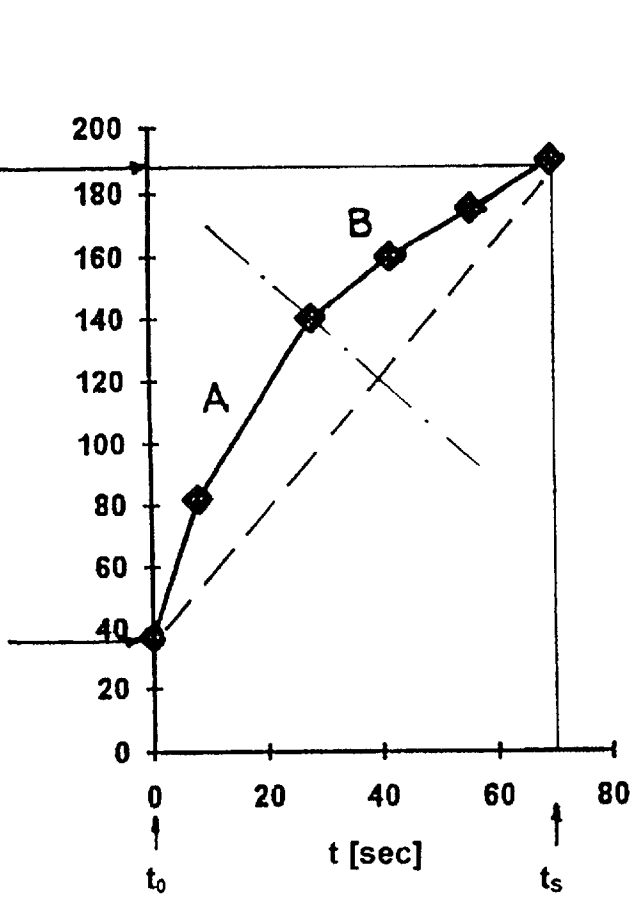
FIG. 2 a set-point curve showing the level of metal in the individual molds as a function of time.
Figure 1:
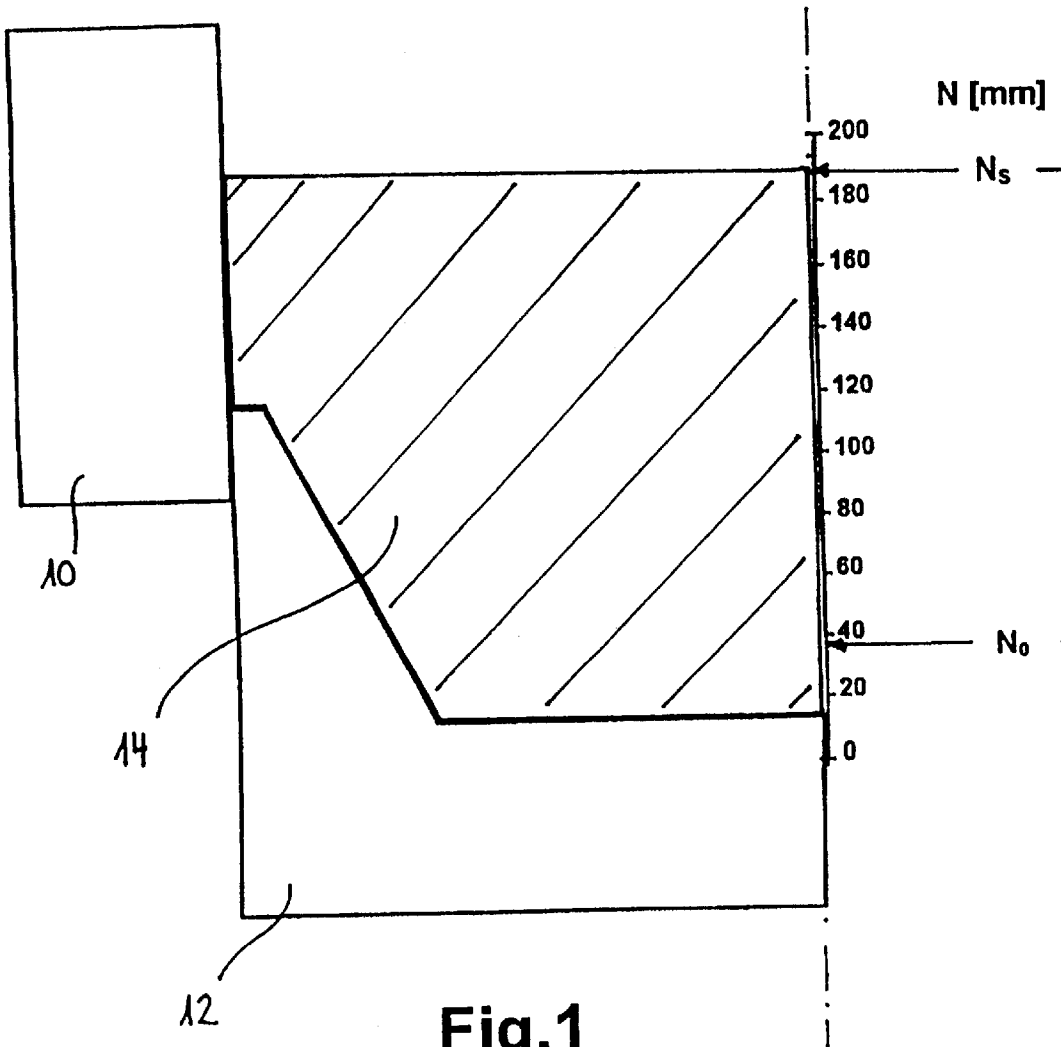
Figure 3:
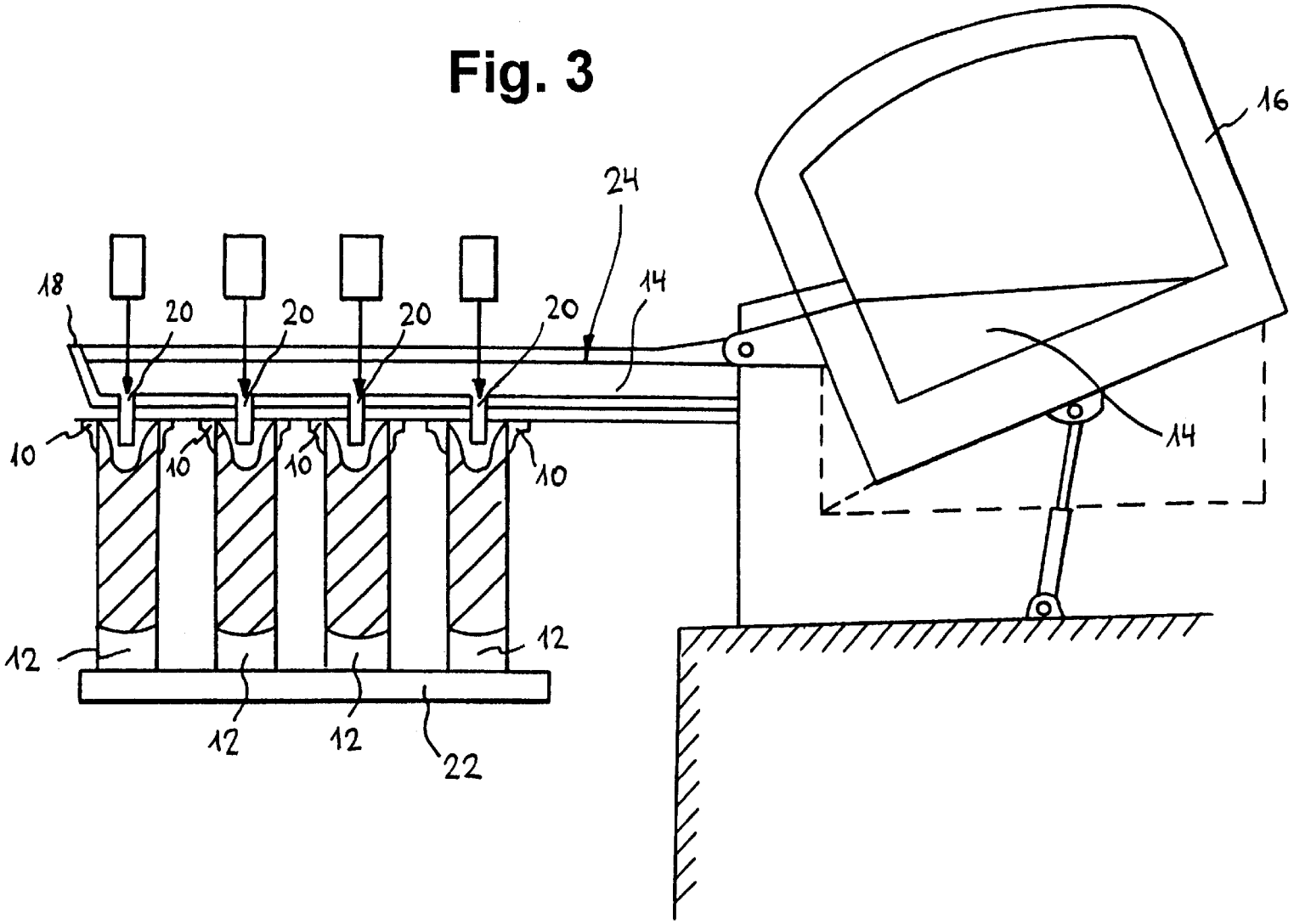
FIG. 3 is a schematic view of a casting facility for carrying out continuous casting.

Before the start of casting, all settings on the casting facility are checked in a test phase. If all starting conditions are in order, the run out spout 18 is filled to a predetermined level 24 by tilting the furnace 16 containing the molten metal

14. As soon as a sensor e.g. an inductive sensor, indicates the prescribed filling height, a sliding plug opens and filling of the dummy block 12 and mold 10 via nozzles 20 with molten metal 14 commences. The level of metal in the dummy block 12 or molds 10 is controlled via an inductive sensor e.g. PID controlled.

As soon as the metal in one mold has reached a predetermined level $N_O$, the adjustment of the level in all molds begins on the basis of a common set-point curve N=f(t) from the initial level $N_O$ at initial time $t_o$ until the starting level $N_S$ at starting time $t_s$ at which the casting table 22 begins to be lowered for the purpose of producing the metal strands.

The set-point curve shown in FIG. 2 may be divided into a range A starting from the initial value $N_0$ and a subsequent range B approaching the starting level $N_S$. It can be readily seen that the range A of the set-point curve exhibits a greater slope than the average slope $(N_S-N_0)/(t_S-t_0)$ indicated in dashed lines. Correspondingly, range B has a smaller slope. In the example shown the set-point curve is formed by 6 pairs of values $N_X$, $t_X$.

The exemplified embodiment illustrated in the drawing refers to the continuous casting of an aluminium alloy in a conventional mold. The method according to the invention may, however, also be used with other casting methods such as for example casing in an alternating electromagnetic field (EMC).

The method is also not limited to casting aluminium alloys. Further materials that may be cast using the method according to the invention are e.g. alloys of magnesium or copper.

The invention is not limited by the embodiments described above which are presented as examples only but can be modified in various ways within the scope of protection defined by the appended patent claims.

What is claimed is:

1. A method for automatic, vertical continuous casting of metals, in a casting facility, comprising the steps of:

feeding liquid metal from a furnace along a spout to nozzles with adjustable through-flow;

guiding the liquid metal from the spout via the nozzles into permanent molds which are initially closed off by dummy blocks arranged on a lowerable casting table;

adjusting a metal through-flow volume of each nozzle individually for each mold based on an initial time ($t_0$) and an initial metal level ($N_0$) at which adjustment of the metal level begins, so that the metal in all molds at a pre-set starting time ($t_s$) is at substantially an equal starting level ($N_s$) at which the casting table starts being lowered for production of metal strands;

lowering the casting table; and adjusting the metal level (N) simultaneously during filling as soon as the initial level ($N_0$) has been reached in at least one of the molds, between the initial level ($N_0$) at the initial time ($t_0$) and the starting level ($N_s$) at the starting time ($t_s$), in all molds as a function of time (t) in accordance with a set-point curve N=f(t) which is identical for all molds, whereby the slope dN/dt of the set-point curve is greater in a first range starting from the initial level ($N_0$) and smaller in a second range approaching the starting level ($N_s$) than a mean slope $(N_s-N_o)/(t_s-t_o)$ between the initial level and the starting level.

2. A method according to claim 1, wherein the set-point curve has a slope greater than the mean slope in a range from 30 to 60% of the entire increase in metal level.

3. A method according to claim 1, wherein the set-point curve has a slope less than the mean slope in a range of 15 to 25% of the entire increase in metal level.

4. A method according to claim 1, wherein the adjusting of the metal level in all the molds begins simultaneously as soon as the initial level has been reached in one mold.

5. A method according to claim 1, wherein the lowering of the casting table with the dummy blocks begins as soon as the starting level has been reached in one mold.

6. A method according to claim 1, including keeping a level of metal in the spout constant from a start of filling the dummy blocks and molds, up to and including a stationary casting phase.

7. A method according to claim 1, wherein the feeding of metal into the molds in accordance with the set-point curve in PID-controlled.

8. A method according to claim 1, wherein the set-point curve is made up of 4 to 8 values ($N_x$, $t_x$).

9. A method according to claim 8, wherein the set-point curve is made up of 5 to 6 values ($N_x$, $t_x$).

* * * * *